United States Patent [19]

Koziol et al.

[11] 4,295,942

[45] Oct. 20, 1981

[54] PROCESS FOR PREPARING MANGANESE OXIDE

[75] Inventors: Konrad Koziol, Rothenbach; Erich Wenk, Nuremberg, both of Fed. Rep. of Germany

[73] Assignee: Conradty GmbH & Co. Metallelektroden KG, Pegnitz, Fed. Rep. of Germany

[21] Appl. No.: 122,060

[22] Filed: Feb. 15, 1980

Related U.S. Application Data

[63] Continuation of Ser. No. 23,346, Mar. 23, 1979, abandoned.

[30] Foreign Application Priority Data

Dec. 13, 1978 [DE] Fed. Rep. of Germany ..... 2853820

[51] Int. Cl.[3] ..... C25B 1/18

[52] U.S. Cl. ..... 204/96

[58] Field of Search ..... 204/96

[56] References Cited

U.S. PATENT DOCUMENTS

| | | | |
|---|---|---|---|
| 3,455,811 | 7/1969 | Bender et al. | 204/96 |
| 3,535,217 | 10/1970 | Amano et al. | 204/96 |
| 4,134,806 | 1/1979 | De Nora et al. | 204/105 M |

FOREIGN PATENT DOCUMENTS

| | | | |
|---|---|---|---|
| 410865 | 3/1925 | Fed. Rep. of Germany | 204/96 |
| 514716 | 12/1930 | Fed. Rep. of Germany | 204/96 |
| 2636447 | 6/1977 | Fed. Rep. of Germany | 204/96 |
| 2645414 | 4/1978 | Fed. Rep. of Germany | 204/96 |
| 2734162 | 2/1979 | Fed. Rep. of Germany | 204/96 |
| 62044 | 5/1966 | German Democratic Rep. | 204/96 |
| 1076973 | 7/1967 | United Kingdom | 204/96 |

*Primary Examiner*—R. L. Andrews

*Attorney, Agent, or Firm*—Staas & Halsey

[57] ABSTRACT

The invention comprises an anode with a core of valve metal for the anodic separation of solid substances. The working surface of the anode having an electrically conductive, corrosion-resistant, mechanically solid coating, which impedes the passivation of the core. The invention further comprises the use of such anodes for the electrolytic preparation of manganese oxides, particularly of manganese dioxides.

12 Claims, 4 Drawing Figures

PROCESS FOR PREPARING MANGANESE OXIDE

This is a continuation of application Ser. No. 023,346, filed Mar. 23, 1979, now abandoned.

BACKGROUND OF THE INVENTION

1. Field of the Invention

This invention relates to anode devices for use in the electrolytic preparation of manganese oxides.

2. Description of the Prior Art

Graphite anode plates which at present are used almost exclusively are subject to strong corrosion in sulfuric acid manganese sulfate electrolytes. The life expectancy of such graphite anodes is moreover abbreviated by damage during removal of the electrolytic manganese dioxide.

According to tests carried out by the applicant, coated titanium anode plates show the important disadvantage that the manganese dioxide coating drops away prematurely in the electrolysis cell. Adequate mechanical stability of the manganese dioxide coatings could not be achieved even by the use of perforated titanium plates, nor by using plates of titanium extended lattice.

SUMMARY OF THE INVENTION

The present invention comprises an anode with a core of valve metal for the anodic separation of solid substances. The working surface of the anode having an electrically conductive, corrosion-resistant, mechanically solid coating, which impedtes the passivation of the core. The invention further comprises the use of such anodes for the electrolytic preparation of manganese oxides, particularly of manganese dioxides.

An object of the present invention is to produce an anode which does not have the disadvantages of the prior art.

This object is attained by the production of an anode of the type named which is characterized in that the working surface of the anode is formed by a plurality of rods mounted parallel to one another and connected by conductive supports.

According to a preferred embodiment of the invention, the rods of the anode have a round cross-section. With this design for anodes, it is possible for the rods to be arranged either horizontally or vertically. These arrangements have proved to be particularly favorable. In order to connect the rods to their supports, it may prove expedient to use an inseparable connection, such as is achieved by welding, for example. But in many cases greater flexibility will be desired, which is attained by connecting the rods with their supports detachably, e.g., by screws. Other securing methods can also be used.

In another embodiment of the invention, vertically arranged rods of the anode are secured by their upper ends directly to the anode suspension.

When using such anodes for the electrolytic preparation of manganese oxides, particularly of manganese dioxide, it is advantageous for the connection of the rods to the supports to be designed in such a manner that a resilient deformation of the rods is possible. The advantageous spring effect of this type of application can also be attained by the resilient design of the rods themselves.

As previously mentioned, valve metals are especially useful as the material for the core of the anode. A particular preference is for the use of titanium. The conductive supports can also consist of valve metals, and especially of titanium. For many purposes it is advantageous for the conductive supports not to have a depassivating coating. According to a further favorable embodiment of the invention, the conductive supports made e.g., from titanium may contain copper cores.

The electrode design according to the present invention is particularly suitable for use in the electrolytic preparation of manganese oxides, particularly manganese dioxide. Thus, for example, an embodiment of the anode design in which both the core and the conductive supports consist of titanium, and in which the rods were designed with a round cross-section of a diameter of 5 mm has proved to be optimal. In this design, the round rods were spaced at about 15 mm intervals (center to center of the rods) and with a horizontal arrangement. In this embodiment, at current densities of about 0.3 $kA/m^2$ it was possible to achieve excellent results per projected anode surface using a one- to two-week working cycle.

Some of the embodiments of the anode according to the invention are shown in the appended drawings, wherein like numerals refer to like parts throughout.

BRIEF DESCRIPTION OF THE DRAWINGS

FIG. 1 shows the rods 1, on the surface of which when used is appropriately deposited manganese dioxide. The rods 1 are held in position and together by means of the conductive supports 2 of sheet titanium by welded seams. The current carrying anode suspension 3 serves to secure the device in the cell.

Figure 2:
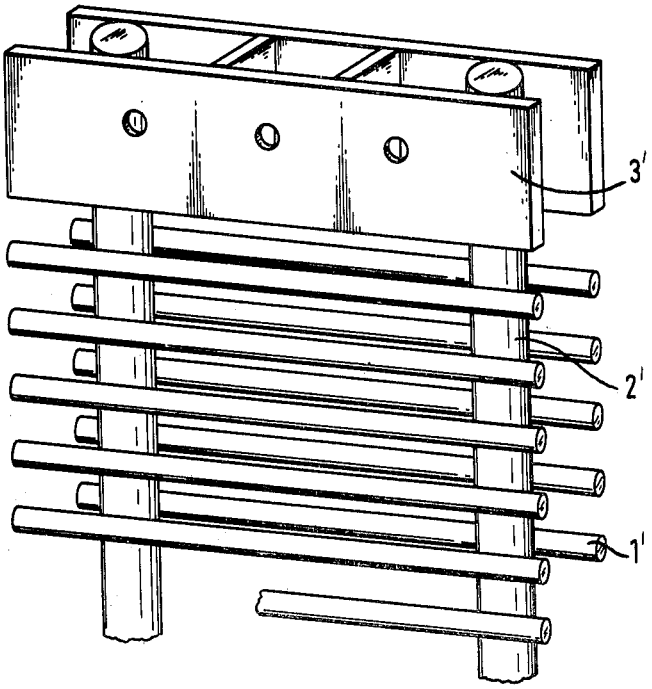
FIG. 2 is a perspective view of another embodiment of the invention.

The embodiment of FIG. 2 shows the conductive supports 2' being designed as rods, and being made of titanium-plated copper. They support rods 1' each of which is provided with a coating. This change and the embodiment of FIG. 2 is characterized by an especially low internal electrical resistance and optimal current distribution. The anode suspension is here designated 3'.

Figure 1:
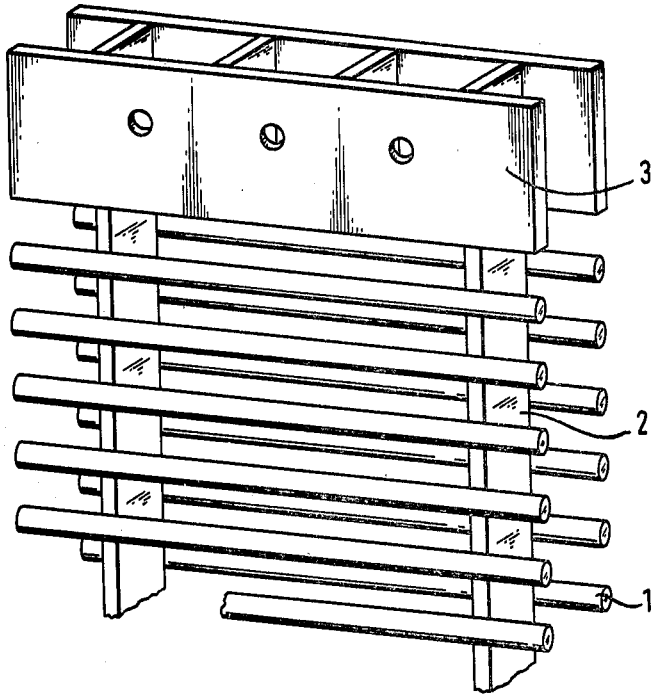
FIG. 1 is a perspective view of one embodiment of the invention.
Figure 3:
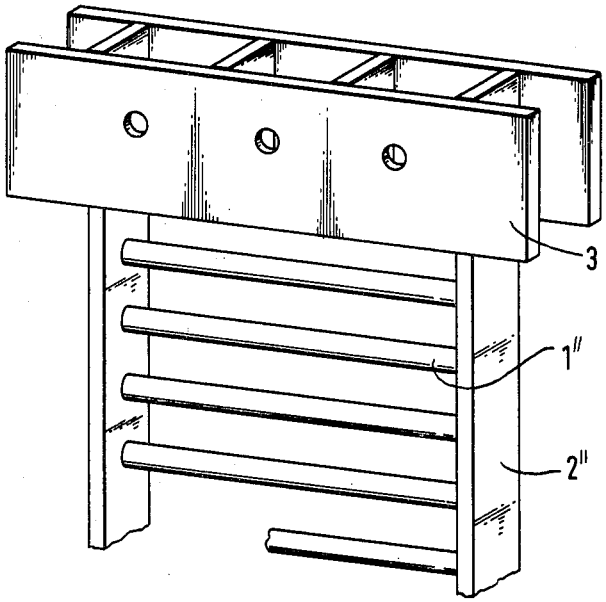
FIG. 3 is a perspective view of a further embodiment of the invention.

FIG. 3 shows in this embodiment, by contrast with the previously described versions, a single-row horizontal arrangement of rods 1''. The spring effect of the rods is here less pronounced than in the case of the rods in the embodiments of FIGS. 1 and 2. Here too the rods 10 are held by conductive supports 2'' made of sheet titanium.

Figure 4:
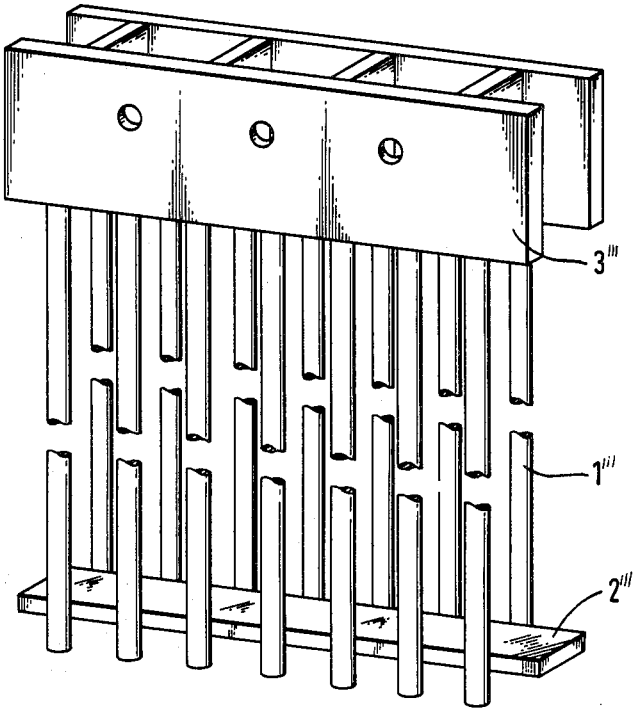
FIG. 4 is a perspective view of a still further embodiment of the invention.

FIG. 4 shows an anode of which rods 1''' are directly welded to the anode suspension 3'''. Support 2''' serves only to hold together the lower ends of the two rows of rods. This embodiment achieves great resilience of the rods.

The surface available for separation in the anodes according to the invention is relatively great, and often greater than that of one with identical external dimensions made of sheet titanium, or a graphite plate anode. The voltage loss is small and minor in the anode designs made according to the present invention.

Thanks to the spring effects of these anode designs, when preparing manganese oxides electricolytically, the manganese dioxide layer can be removed with little effort and without damaging the anode. Surprisingly it has been discovered that the removal of manganese dioxide from the anodes according to the present invention is possible without uncoupling solely by heating, e.g., to about 100° C. above the respective separation temperature of the manganese dioxide. These anodes, thereby for the first time permit the automation of the process for preparation of manganese dioxide.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

We claim:

1. The process for the electrolytic preparation of maganese oxides using an anode having a core of valve metal, the working surface of which has an electrically conductive, corrosion-resistant, mechanically solid coating which impedes the passivation of the core, wherein the working surface of the anode comprises the surfaces of a plurality of rods which are mounted in parallel, and the rods are connected by conductive supports, wherein the desired electrolysis product is a solid and not a gas.

2. A process according to claim 1, wherein the rods used in the electrolytic preparation of maganese oxide have a round cross-section.

3. A process according to claim 1 or 2, wherein the rods used in the electrolytic preparation of maganese oxides are mounted horizontally.

4. A process according to claim 1 or 2, wherein the rods used in the electrolytic preparation of maganese oxides are mounted vertically.

5. A process according to claim 1 or 2, wherein the rods used in the electrolytic preparation of maganese oxides are inseparably connected with the conductive supports by welding.

6. A process according to claim 1 or 2, wherein the rods used in the electrolytic preparation of maganese oxides are detachably connected with the supports by screws.

7. A process according to claim 4, wherein the vertically mounted rods used in the electrolytic preparation of maganese oxides are secured by their upper ends directly to an anode suspension.

8. A process according to claim 1 or 2, wherein the connection of the rods used in the electrolytic preparation of maganese oxides to their supports is so designed that a resilient deformation of the rods is possible.

9. A process according to claim 1 or 2, wherein the rods used in the electrolytic preparation of maganese oxides are resiliently designed.

10. A process according to claim 1 or 2, wherein the conductive supports do not have a depassivating coating.

11. A process according to claim 1 or 2, wherein the conductive supports consist of titanium and contain copper cores.

12. A process according to claim 1 or 2, wherein the valve metal of the core is titanium.

* * * * *